United States Patent [19]

Wootton

[11] Patent Number: 4,604,554

[45] Date of Patent: Aug. 5, 1986

[54] TRIGGERED SPARK GAP DISCHARGER

[75] Inventor: Roy E. Wootton, Murrysville, Pa.

[73] Assignee: The United States of America as represented by the Secretary of the Air Force, Washington, D.C.

[21] Appl. No.: 617,449

[22] Filed: Jun. 5, 1984

[51] Int. Cl.[4] ..... H01J 17/36; H01T 2/02

[52] U.S. Cl. ..... 315/330; 315/327; 313/325; 313/307; 313/308; 361/120; 361/130

[58] Field of Search ..... 315/330, 327; 313/325, 313/307, 308; 361/120, 130

[56] References Cited

U.S. PATENT DOCUMENTS 3,710,178 1/1973 Johnson et al. ..... 315/330 X
4,054,813 10/1977 Agnoux et al. ..... 313/325
4,142,220 2/1979 Lundsgaard ..... 361/120

FOREIGN PATENT DOCUMENTS 3115153A 11/1982 Fed. Rep. of Germany ..... 313/325

OTHER PUBLICATIONS

Naff et al., "Design and Performance of a High Repetition Rate Spark Gap Switch at 50-kW Power Levels," IEEE Conference Record of the 1980 Fourteenth Pulse Power Modulator Symposium, USA.

Cullington, E. H. et al, "Low-Voltage Trigger", *Electronics,* Apr. 11, 1958, pp. 86-88.

"The Theory and Design of the Triggered Spark Gap", by T. J. Williams, Report SCTM 186-59-[14], pp. iv, v, 1, 2, 10, 57, 178, 179.

"Ceramic-Metal Triggered Spark Gaps", EG&G Data Sheet C6000E-1, Electro-Optics Division.

*Primary Examiner*—David K. Moore
*Assistant Examiner*—Vincent DeLuca
*Attorney, Agent, or Firm*—Donald J. Singer; Richard J. Donahue

[57] ABSTRACT

A triggered spark gap discharger having a small auxiliary gap in the trigger pulse path. The auxiliary gap provides ultraviolet radiation to liberate electrons at the trigger probe and allow prompt firing of the trigger gap and primary gap, particularly in aged discharger units.

8 Claims, 3 Drawing Figures

TRIGGERED SPARK GAP DISCHARGER

STATEMENT OF GOVERNMENT INTEREST

The invention described herein may be manufactured and used by or for the Government for governmental purposes without the payment of any royalty thereon.

BACKGROUND OF THE INVENTION

The present invention relates to spark gap devices and particularly to a triggered spark gap discharger of improved design and operation.

A need exists for devices capable of rapidly switching or discharging high currents with a relative low voltage drop thereacross. Transistors and vacuum tubes are capable of handling currents of a few amperes. Cold cathode trigger tubes and thyratrons are useful in switching several hundred amperes. At higher voltages and currents of a few thousand amperes, ignitrons are required. For very high operating voltages and currents, triggered spark gaps come into use.

A conventional triggered spark gap discharger consists essentially of a pair of electrodes spaced far enough apart such that the voltage applied across the electrodes is insufficient to electrically break down the gap therebetween. The gap remains a very good insulator at voltages below its hold-off value. When it is desired to initiate the flow of current, a method must be provided to cause sufficient ionization of the gas between the electrodes to allow the gap to breakdown. This may be accomplished by a sudden increase of the voltage across the gap, a sudden reduction in the gap spacing, a sudden reduction in gas density, natural radioactive irradiation of the gap, ultraviolet irradiation of the gap, a heated filament in the gas dielectric, distortion of the electric field of the gap, or injection of ions and/or electrons into the gap.

Commercially available triggered spark gap dischargers, commonly known as triggertrons, consist of a pair of hemispherical primary electrodes with an axial trigger probe in one electrode. Upon application of a trigger pulse, an auxiliary spark is generated inside the gap between the trigger probe and its associated primary hemispherical electrcde, or the other primary electrode, depending upon the gap design and the polarity of the electrodes. The auxiliary spark provides a source of electrons and ions and forms a low-density region due to the energy dissipated by the trigger spark. The combination is mounted in a sealed chamber filled with an ionizable gaseous medium.

One application for such a triggered spark gap discharger is in the protection of klystrons from damage due to internal short circuits by preventing occasional breakdown currents therein from reaching values of more than a few hundred amperes. Since this current may reach a few hundred amperes in about 20 nanoseconds, the triggered spark gap must fire reliably and very promptly if it is to protect the klystron adequately. Failure of the trigger spark gap to fire can lead to damaging currents of several thousand amperes through the klystron.

The triggering circuit may be such that a large trigger signal, in the order of sixty percent or more of the main gap voltage, is available on the triggering probe before the flashover of the klystron lowers the main gap voltage appreciably. Thus, the triggering circuit provides a large and fast trigger signal while the voltage on the main electrodes is still high. Very fast and reliable triggering of the spark gap is required in response.

Since flashover in the klystron may occur while the supply voltage is being increased from zero, it is also necessary that the triggered spark gap discharger work at reduced main gap and trigger voltages. The triggered spark gap discharger must, in a particular application, operate within about 120 nanoseconds at 60 to 100 kilovolts across the main gap electrodes and within 300 nanoseconds at 55-59 kilovolts thereacross. Since the current increases rapidly with time, if the gap fails to fire, the current in the klystron reaches nearly four times the permitted level within one microsecond. Thus, it is important that the triggered gap operate reliably and fast to as low a voltage as possible.

Newly manufactured triggered spark gap dischargers have sharp-edged tips to the trigger probes, and these edges easily emit electrons by field emission. As the devices age, however, the tips of the trigger probes or pins become rounded by erosion by the sparks, and there is then typically a delay before an electron is available to initiate a trigger spark. This delay causes performance of the dischargers to deteriorate, with consequent deleterious effects upon associated devices and/or circuitry.

OBJECTS AND SUMMARY OF THE INVENTION

It is therefore an object of the present invention to provide a triggered spark gap discharger of improved performance, particularly in aged spark gap dischargers.

It is a further object of the present invention to provide a triggered spark gap discharger having more reproducible firing behavior.

In accordance with the present inventon, the triggered spark gap device comprises a sealed chamber having a pair of opposed electrodes defining the main arc gap in the chamber. The chamber has an ionizable gas therein. One of the electrodes includes a triggering probe which, together with one of the main electrodes, provides a trigger gap for forming a trigger spark.

The trigger pulse is applied to the trigger probe via a small auxiliary gap which breaks down and provides preliminary ultraviolet light which irradiates the trigger probe and hence liberates electrons at the trigger probe. An external capacitor is provided to assist in promoting early breakdown of the trigger gap and additional capacitors may be utilized to allow a more uniform voltage distribution on the switch envelope.

For a better understanding of the present invention, together with other objects, features and advantages of the invention not specifically mentioned, reference should be made to the accompanying drawing and following description, while the scope of the invention will be pointed out in the appended claims.

BRIEF DESCRIPTION OF THE DRAWING

Referring to the drawings.

DESCRIPTION OF THE PREFERRED EMBODIMENT

Figure 1:
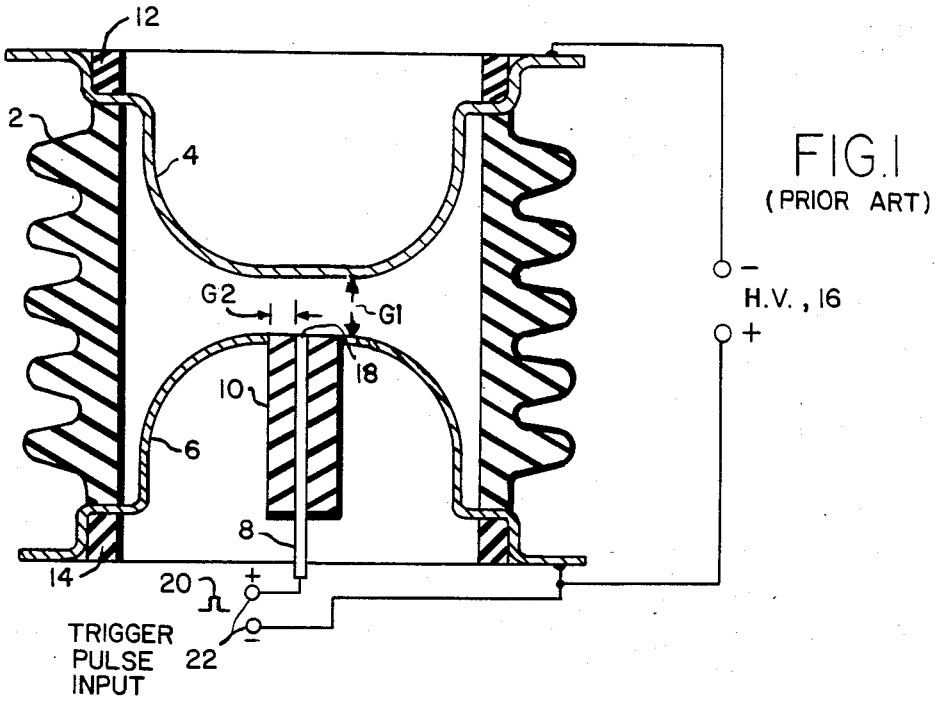
FIG.1 (PRIOR ART)
FIG. 1 is a cross-sectional view of a conventional triggered spark gap discharger.

The spark gap discharger shown in axial cross-section in FIG. 1 is of conventional construction and is commerically available. It consists of a cylindrical porcelain insulator 2 having a pair of primary electrodes 4 and 6 enclosing the ends thereof. Electrcde 6 has an axially aligned trigger probe or pin 8 therethrough, which is insulated from electrode 6 by a porcelain tube 10. Insulative rings 12 and 14 are located at the open surfaces of the substantially hemispherical electrodes 4 and 6. The spark gap discharger is filled with an ionizable gas which, for example, may be a mixture of nitrogen and a small amount of oxygen.

The gap G1 between electrodes 4 and 6 is the primary gap for discharge of high voltage applied across electrodes 4 and 6 via terxinals 16. A trigger spark gap G2 is formed between the tip 18 of trigger probe 8 and primary electrode 6. A trigger pulse 20 is applied between trigger probe 8 and main electrode 6 via terminals 22. As mentioned earlier, the trigger gap G2 breaks down under the influence of trigger pulse 20 to provide a source of electrons to initiate the breakdown of the primary gap G1.

Figure 2:
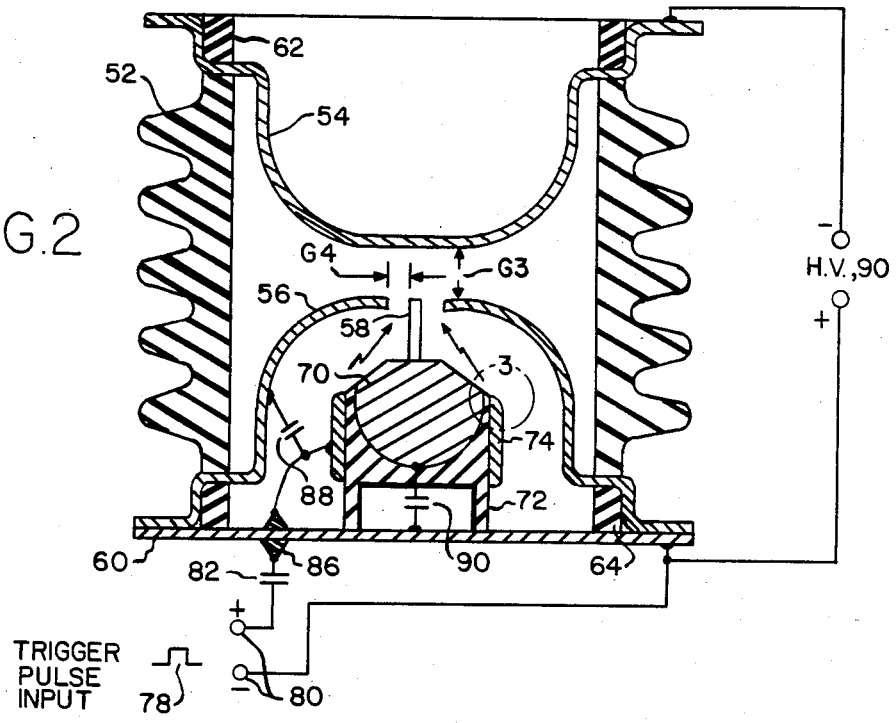
FIG. 2 is a cross-sectional view of a triggered spark gap discharger constructed in accordance with the teachings of the present invention.

FIG. 2 is a cross-sectional depiction of the triggered spark gap discharger of the present invention. As in the case of the prior art device of FIG. 1, the novel triggered spark gap discharger includes a cylindrical porcelain insulator 52 having a pair of primary electrodes 54 and 56. Primary electrode 54 encloses the top end of the cylindrical insulator 52 while primary electrode 56 is positioned over the bottom of insulator 52. Unlike the prior art discharger of FIG. 1, the primary electrode 56 does not completely enclose the space between the electrodes but has an opening in the area surrounding the trigger probe or pin 58. The bottom of insulator 52 is however enclosed by metallic disc 60 positioned over the flange of primary electrode 56. Insulative rings 62 and 64 are positioned at the inner rims of primary electrodes 54 and 56 respectively. The spark gap discharger of FIG. 2 is also filled with an ionizable gas which preferably consists of nitrogen with a one percent addition of oxygen. It will be apparent that not only the volume in the vicinity of the primary gap G3 and the trigger gap G4, but the enclosed volume below the primary electrode 56 is sealed to contain the aforementioned gas mixture.

Figure 3:
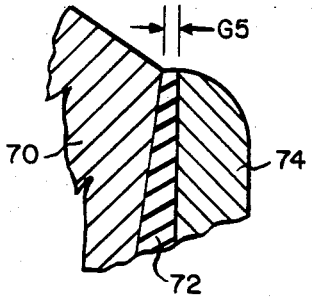
FIG. 3 is an enlarged view of the auxiliary gap portion of FIG. 2.

A trigger gap G4 is formed between the tip of the trigger pin 58 and the edges of the hole formed through the center of primary electrode 56. Trigger pin 58 is embedded in a metallic block 70 which is supported by insulative pedestal 72. A metallic ring or band 74 surrounds pedestal 72 and is insulated thereby from metallic block 70. The area 3 of FIG. 2 is enlarged in FIG. 3 to better illustrate the auxiliary gap G5 formed between metallic block 70 and metallic band 74. The function of this gap G5 will be described in detail below.

Trigger pulses 78 are applied to trigger pulse terminals 80, one of which is connected to disc 60, and the other to one end of coupling capacitor 82. The other end of capacitor 82 is connected to metallic ring 74 via insulative feedthrough 86. A capacitor 88 is electrically connected between metallic ring 74 and primary electrode 56 while a capacitor 90 is connected between metallic block 70 and disc 60. The high voltage to be discharged is applied across terminals 90.

In operation, the trigger pulse 78 applied to terminals 80 charges the capacitors 82 and 88. A potential is reached at which the auxiliary gap G5 breaks down. This occurs before the voltage on the trigger pin 58 reaches a level for breakdown of the trigger gap G4. This auxiliary gap G5 may be only ten percent or so of the length of the trigger gap G4 and hence is initially very much over-volted. This overvoltage is such that the auxiliary gap G5 has a very small delay to breakdown. Existence of a small capacitance 88 assists in promoting early breakdown, and the optimum value of capacitor 88 will depend upon the trigger pulse source impedance, trigger pulse rise-time, among other factors. Capacitor 90 may be used to allow a more uniform voltage distribution.

After breaking down the auxiliary gap G5, the voltage on trigger pin 58 rises, and breakdown of the trigger gap G4 follows promptly on reaching the trigger gap breakdown voltage because electrons released by the ultraviolet (UV) irradiation from the auxiliary gap G5 will already be present. The breakdown of the trigger gap G4 then rapidly precipitates the breakdown of the primary gap G1 to discharge the high voltage across terminals 90.

The auxiliary gap G5 also acts as a "sharpening gap" which causes the voltage at the trigger pin 58 to rise more rapidly than would be the case in the absence of this gap. It also promotes more reproducible firing behavior.

It will be apparent that the auxiliary gap may be formed of auxiliary electrodes having different forms and that the auxiliary electrodes can be positioned in other areas within the sealed environment. The auxiliary gap, for example, might be formed by a pair of auxiliary electrodes positioned in the area between the primary electrodes 54 and 56, provided the auxiliary electrodes are in the trigger pulse path and that the breakdown of the gap provides ultraviolet energy in the vicinity of the trigger gap.

Although the invention has been described with reference to a particular embodiments, thereof it will be understood to those skilled in the art that the invention is capable of a variety of alternative embodiments within the spirit and scope of the appended claims.

What is claimed is:

1. A triggered spark gap discharger comprising:
means forming a chamber;
first and second primary electrodes having opposed electrode surfaces and defining a primary arc gap within said chamber;
an ionizable gaseous medium in said chamber;
a trigger electrode assembly having a trigger probe defining a trigger gap between itself and said first primary electrode, said trigger gap being smaller than said primary gap;
said trigger electrode assembly having a metallic member insulated from said trigger probe defining an auxiliary gap between itself and said trigger probe, said auxiliary gap being shorter than said trigger gap;
means for applying a high voltage between said primary electrodes; and
means for connecting a trigger pulse source between said metallic member and said first primary electrode.

2. Apparatus as defined in claim 1 and further comprising:

a first capacitance means electrically connected between said metallic member and said first primary electrode;

a second capacitance means electrically connected between said trigger probe and said first primary electrode; and a third capacitance means electrically connected between said metallic member and said trigger pulse source.

3. Apparatus as defined in claim 2 wherein said ionizable gaseous medium is a mixture of nitrogen and oxygen.

4. Apparatus as defined in claim 3 wherein said means forming a chamber comprises a cylindrical porcelain insulator.

5. Apparatus as defined in claim 4 wherein said first and second primary electrodes have a substantially hemispherical shape.

6. Apparatus as defined in claim 5 wherein said first primary electrode has an axial hole therethrough and wherein said trigger probe is axially disposed with said first primary electrode.

7. Apparatus as defined in claim 6 wherein said metallic member comprises a metallic band surrounding said trigger probe.

8. A triggered spark gap device comprising:

means forming a chamber;

a pair of primary electrodes having opposed electrode surfaces and defining a primary arc gap within said chamber;

an ionizable gaseous medium in said chamber;

a trigger electrode assembly having a trigger probe defining a trigger gap between itself and one of said primary electrodes, said trigger gap being smaller than said primary gap;

an auxiliary electrode assembly defining an auxiliary gap within said chamber, said auxiliary gap being smaller than said trigger gap;

said auxiliary gap being in series with said trigger gap;

means for applying a high voltage between said primary electrodes; and means for applying a trigger pulse through said auxiliary gap and said trigger gap.

* * * * *